United States Patent [19]

Lindstadt et al.

[11] Patent Number: 4,712,480

[45] Date of Patent: Dec. 15, 1987

[54] RE-SECURABLE MINE

[75] Inventors: Klaus Lindstadt, Schwaig; Andreas Halssig, Denkingen; Dietmar Maier, Rodenbach; Stefan Scholz, Alzenau, all of Fed. Rep. of Germany

[73] Assignee: DIEHL GmbH & Co., Nuremberg, Fed. Rep. of Germany

[21] Appl. No.: 922,070

[22] Filed: Oct. 20, 1986

[30] Foreign Application Priority Data

Oct. 31, 1985 [DE] Fed. Rep. of Germany ..... 3538786

[51] Int. Cl.[4] ..... F42C 11/00; F42C 15/14

[52] U.S. Cl. ..... 102/427; 102/215; 102/401; 102/424

[58] Field of Search ..... 102/427, 424, 419, 420, 102/215, 221, 401

[56] References Cited

U.S. PATENT DOCUMENTS

| | | | |
|---|---|---|---|
| 2,411,787 | 11/1946 | Hammond, Jr. | 102/427 |
| 3,509,791 | 5/1970 | Pechamat | 102/427 |
| 4,296,686 | 10/1981 | Marer | 102/427 |

FOREIGN PATENT DOCUMENTS 2423912 3/1978 Fed. Rep. of Germany .

*Primary Examiner*—Charles T. Jordan

*Attorney, Agent, or Firm*—Scully, Scott, Murphy & Presser

[57] ABSTRACT

A re-securable mine including a triggering or ignition circuit which is actuatable through the intermediary of a trigger securing arrangement. A re-securing block with a comparator is provided for a pregiven information or code and for an introduceable information or code, so as to reset the securing arrangement into the secured position at a pregivable relationship between the two informations or codes.

12 Claims, 3 Drawing Figures

Fig. 1

RE-SECURABLE MINE

BACKGROUND OF THE INVENTION

1. Field of the Invention

The present invention relates to a re-securable mine including a triggering or ignition circuit which is actuatable through the intermediary of a trigger securing arrangement.

2. Discussion of the Prior Art

A mine of the type under consideration is known from the disclosure of German Laid-Open Patent Application No. 24 23 912. The mine can be converted into a renewed secured position, when the previously deployed and armed mine is again to be removed, without being brought to detonation thereby.

SUMMARY OF THE INVENTION

Accordingly, it is an object of the present invention to equip a mine of the species under consideration so as to substantially increase the flexibility of its capabilities of utilization through an easily manipulatable securing block against any unauthorized mine removal.

The foregoing object is inventively achieved through a mine as disclosed herein, through the provision of a re-securing block or obstruction with a comparator for a pregiven information or code and for an introduceable information or code, so as to reset the securing arrangement into the secured position at a pregivable relationship between the two informations or codes.

In accordance with the foregoing, during the mine installation or deployment and prior to the arming of the mine, only information which is accessible to authorized personnel is stored into the mine, which leads to the renewed secure or safe position of the triggering device and, as a result, to a renewed safe handling for a relocating of the mine when, after its arming, there is to be again introduced an applicable information or code. As a result thereof, the mine can be utilized at different locations at full operational capability; whereas, for example, it would be brought to detonation (for example, cannot be examined by the enemy with regard to its technological construction or even employed itself) when manipulation is imparted to the securing block, especially when an inapplicable information or code should be introduced, which does not lead to re-securing.

The mine is conceived to especially relate to a remote-controlled mine with a complex triggering sensor, such as is generally elucidated in the disclosure of U.S. Pat. No. 3,509,791. Inasmuch as such a mine, subsequent to arming thereof, is initially deployed in a lurking position, and is only switched over to a condition of triggering readiness, for example, when a seismic sensor reports the approach of a target object, whose acquisition for attacking thereof can then be implemented by means of an infrared sensor, the mine is accessible relatively safely to the handling or deploying crews, so as to again be disassembled at a location at which it is no longer required, and to again be installed at a distant location. For this purpose, it is necessary that the securing arrangement can be reversably brought back into the secure or safe position, which would only be permissible to authorized personnel. Authorized personnel are only those who have access to the code of the securing block; for example, since they themselves have predetermined a certain code during the setting up of the mine (and preferably coincidingly all mines of a certain deploying up or locating area).

Hereby, there is carried out the expedient storing in and comparison of the pregiven code and the subsequently introduced securing code for overcoming the block within the electronic circuit, in which there is also implemented the sensor signal processing; in essence, for example, by means of further logic junctures or information processing in processor-controlled installations.

BRIEF DESCRIPTION OF THE DRAWINGS

Additional alternatives and modifications, as well as further features and advantages of the invention can now be readily ascertained from the following detailed description of exemplary embodiments of the invention, taken in conjunction with the accompanying drawings; in which.

DETAILED DESCRIPTION

Figure 1:
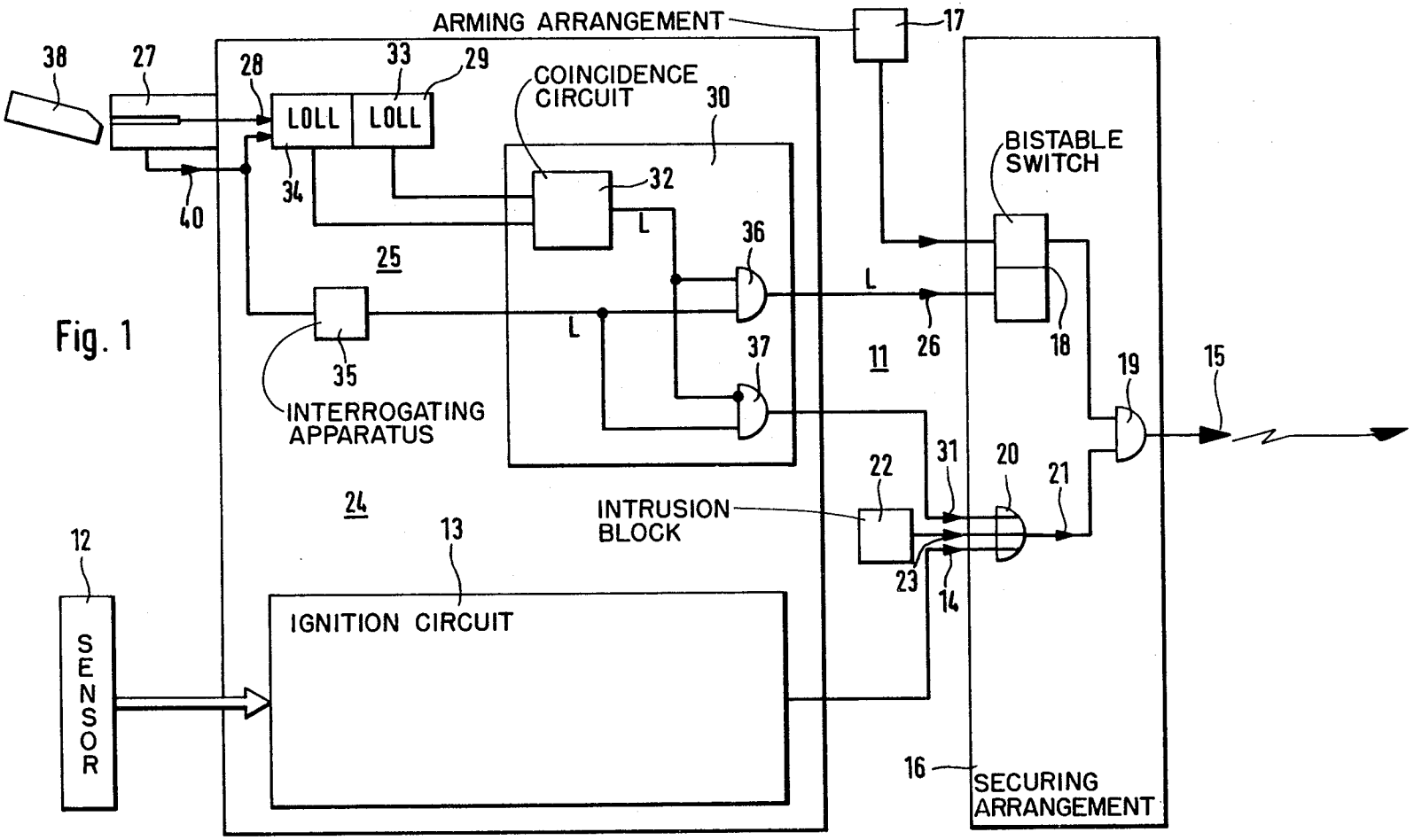
FIG. 1 illustrates a simplified circuit block diagram in which, in addition to the sensor signal processing, there is provided the signal processing for a securing block of a reversible electronic triggering or detonating arming arrangement.

The mine 11 is equipped with a triggering sensor 12 and with a trigger or ignition signal processing circuit 13 which is connected to the output of the triggering sensor for the obtention of a target detection signal 14, which releases a triggering signal 15 for the activation of a warhead employed for the attacking of the acquired target object.

Through the utilization of a securing arrangement 16 there is afforded that the triggering signal 15 can only then be initiated when, after the deployment of the mine 11, there is activated an arming arrangement 17 which, pursuant to the symbolically simplified circuit block diagram of FIG. 1; for example, through a delay arrangement (not shown) sets a bistable switching element 18 and thereby readies a trigger signal output gate 19. The AND condition thereof is fulfilled; in effect, the gate 19 is rendered conductive, when an OR-gate 20 delivers a release signal 21, inasmuch as there is delivered from the sensor 12 a trigger detection signal 14, or from an evacuation or intrusion block 22 (for example, such as an inertial switch which is responsive to a tilting of the mine 11) for delivering an evacuation or intruder blocking signal 23.

However, when the mine 11 is no longer required at the previously provided locale due to a changed combat area, and instead thereof should be deployed at another location, the securing arrangement 16 must again be switched over into the secure or safe position, thus, for example, the bistable switching element 18 must be reset, in order to again suspend the switching into a prepared state by the gate 19; whereby after renewed deployment, the mine 11 can again be unsecured or armed, in that the switching element 18 is again set through the arming arrangement 17. However, there must be ensured that no unauthorized person can again secure the mine, and thereby render the mine inoperative at the provided active location. For this purpose, within the framework of the electronic circuits 24 containing the sensor signal processing arrangement 13, there is formed a (re-) securing block 25. The latter is so designed that a resetting signal 26 can only be delivered to the bistable switching element 18 in the securing arrangement 16, when a signal code 28 is introduced through an input device 27, which stands in a certain relationship with a pregiven (re-) securing code 29, for example, coincides with the code. In the event that this is the case, a comparator 30 will respond and trigger the resetting signal 26 in order to again transfer the securing arrangement 16 into the secured condition; in effect, to be able to again deploy the mine at another location without any danger of detonating the explosive. However, should an unauthorized person introduce information, which does not stand in a certain relationship with the securing code 29, by means of the input device 27, then the comparator 30 delivers a blocking signal 31 which again leads, through the OR-gate 20, to the switching through of the output gate 19, in effect, to the emission of a triggering signal 15.

When identical codes 28/29 are provided for the inhibiting of an unauthorized re-securing, then the comparator 30 especially possess a coincidence circuit 32, to which there are connected a data or program storage 33 and an input storage 34 for the two codes 29, 28. With the completion of the input to the device 27, by means of an interrogating apparatus 35 there is interrogated the output signal of the coincidence circuit 32 and, when required, is transmitted through an AND-gate 36 as the resetting signal 26 which then again reconveys the securing arrangement 16 from its heretofore armed condition into the secured condition. In contrast therewith, a gate 37 with an inverted input switches through or becomes conductive when the circuit 32 does not determine any coincidence, so as to deliver the blocking signal 31, in effect, to release the triggering signal 15 (inasmuch as, apparently, an unauthorized person is manipulating the mine 11 and, as a result, the warhead should be brought to detonation).

For the input of the codes 28/29, the input device 27 can be equipped as a sensing or readout device, for example, for a card with impressed binary codes. This can be stored as generally a line pattern, as a magnetized pattern or as a punch pattern on the card 38, and can be read off by the input device 27 either serially or in parallel into the input storage 34, whereupon the apparatus 35 is triggered by the input device 27 for the receiving of the implemented interrogatory (code acceptance). The employment of a card 38 as the information carrier for the input of the codes 28, 29 is particularly expedient when a plurality of mines 11 are deployed within an area which, for simplification in handling by the mine combat engineer can be collectively equipped with a securing block 25 for the same re-securing code 29, so as to practically preclude any wrong connections by authorized personnel during evacuation of the mine field. For this purpose, it is expedient to provide a coding device for the card 38, by means of which there is introduced a preselectable code 28 (for example, imprinted, through a line pattern stamp, or impressed by means of a simple mechanical hole punch), with the transfer of this thereby predetermined information from the card 38 by means of the input device 27 initially into the first storage 34 then the later securing code 29. When, thereafter, the input device 27 is again to be actuated, the content of the first storage 34 is then transferred into the second storage 33, and the new read-in code 28 is received in the first storage 34. In the event that the comparator 30 determines a coincidence between the content of the two storages 33 and 34 then, as described, there is emitted the resetting signal 26 for the securing arrangement 16. Thus, the information is safely protected by means of the pregiven securing code 29; in that, for example, a single mine combat engineer can, after the deployment of a group of mines 11, punch a freely-selectable information as the code 28 into the card 38, and store this in the securing block 25 as the securing code 29 which is applicable to each group of mines. Only that person has this card 38 available, so that only he is authorized and capable, through insertion of the same card 38 into the scanning or reading slot of the input device 27, to again introduce the same code 28, and to thereby surmount the block 25; in effect, to again secure the mine 11.

Figure 2:
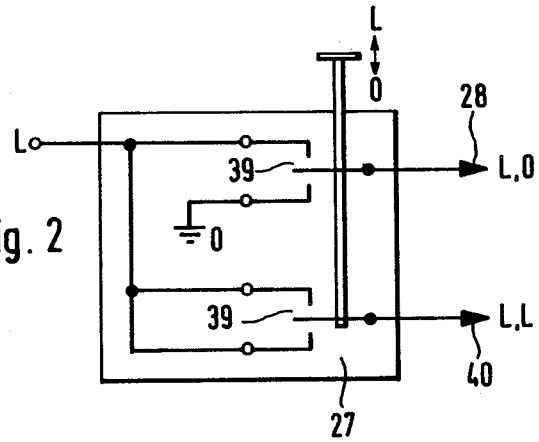
FIG. 2 illustrates an example of a keying switch for the manual code input pursuant to FIG. 1.

However, the input device 27 can be simply designed as a change-over switch for the input of a sequence of binary signals as the codes 29, 28, such as is illustrated in FIG. 2. In the signal pulse beat of the code 28 there is triggered a pulse sequence for the further switching of the information at the input into the storage 34 (for example, for the continuous scanning during the information acceptance in a slide register). For example, when the code 28, as considered in FIG. 1, represents a four-bit information, then the change-over switch 39 must be operated four times, and the code 28 is introduced into the first storage 34.

When later on, for the removal of the mine 11, there is again operated the change-over switch 39 four times in the same manner, then the information 28 is transferred from the first storage 34 as the securing code 29 into the second storage 33, and the newly introduced information is assumed as a signal code 28 in the first storage 34 so as to thereafter, as described, evaluate by means of the comparator 30 both storage contents. Thus, the interrogating device 35 responds when there has occurred a pulse sequence 40 constituted of two times four bits; in essence, it is simply designable as a counter for the counting volume eight for the pulse sequence 40.

Figure 3:
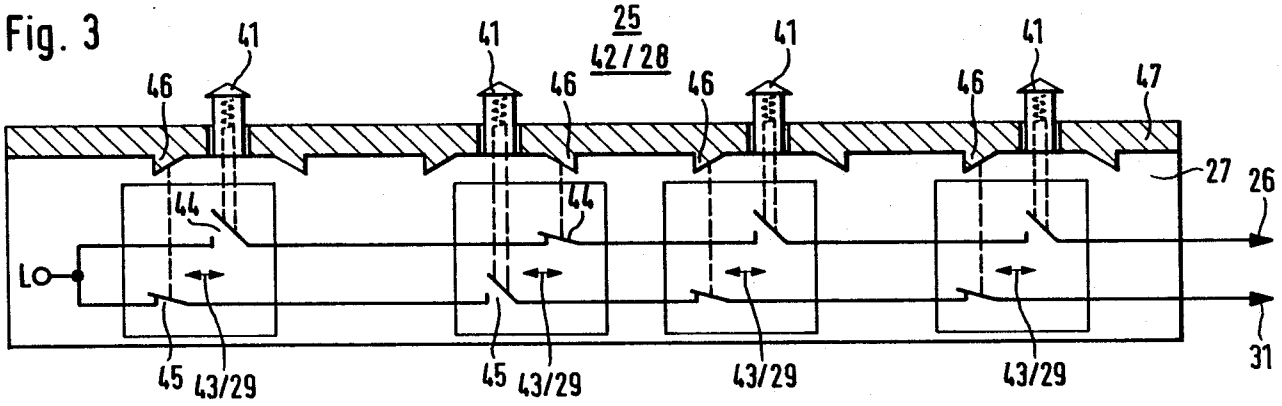
FIG. 3 illustrates an example for a keying array for a code input with electronic juncture.

A considerably simplified exemplary embodiment of an electromechanical input device 27 with an electrical interlock is represented in FIG. 3. Through the intermediary of manually operable, spring-elastically reconveyable plungers 41 of a keyboard 42, there can be presently activated one of two switching possibilities which are illustrated, for purposes of clarity, as displacable switch groups 43, of which one switch section 44 is presently associated for the delivery of a resetting signal 21, and another switch section 45 for the delivery of a securing blocking signal 31. The resetting switch sections 44 are electrically connected in series. Those which are not located in the operative region of a depressable plunger 41, are forcibly closed, such as by means of a ramp 46 which is fastened to the device. The other resetting switch sections 44, which are displaced within the region of influence of their associated plungers 41, are closed through manual actuation of their plungers 41, such that the series circuit is completed and there is emitted the resetting signal 26.

When one of the plungers 41, due to the applicable displacement of the switch group 43, has no resetting switch section 44 associated therewith, forcibly associated therewith is a blocking switch section 45. When an unauthorized person, who has no knowledge of the displaced position of the switch groups 43, has the intention to switch through a resetting signal 26, also actuates this other plunger 41, a blocking signal 31 is triggered and the mine 11 is detonated.

In the illustration pursuant to FIG. 3 there is also provided that of the four plungers 41, only one is associated with the blocking switch section 45, whereas in contrast therewith, the other switch sections 45 are maintained closed by ramps 46, so that the blocking switch sections 45 can similarly be electrically connected in series. However, should there be provided a securing code 29 which is represented by the displaced position of the switch groups 43, in which also the actuation of another plunger 41 can lead to the release of the blocking signal 31, then the blocking switch sections 45 are to be electrically connected in parallel with each other (and not subjected to the influence of closure ramps 46; not illustrated in the drawing).

The mine combat engineer, during the deployment of a group of mines 11, displaces their switch groups 43 in conformance with a predetermined securing code 29, in which he lifts up an equipment cover 47 of the securing block 25, and sets the switch groups 43 which are accessible therebelow into the coded position. Thereafter, the cover 47 is locked, for example, electromechanically, in that the arming arrangement 17 (FIG. 1) is actuated, such that no unauthorized person can open the cover 47 and remember the displaced position of the switch groups; with the tripping, for example, of the evacuating block 22 during any attempt at forcibly opening the cover 47. Only an authorized person is informed as to which plungers 41 (for example, distinguished by numbers or color) are allowed to be and must be actuated in the given coding instance, so as to alone trigger the resetting signal 26 (however, in no instance triggering the blocking signal 31), and to again release the latching of the cover 47 in order to be able to set another re-securing code 29.

In the simplified representation of the drawing, it is not considered that it can be expedient to combine the function of the arming arrangement 17 with that of, for instance, the input device 27, wherein a clearing code 29 is introduced in which there is simultaneously set (for example, when required through a delay device) the bistable switch element 18; in effect the securing arrangement 16 is armed.

Additionally, through the input of the clearing code 29, there can be caused that the sensor signal processing circuit 13, or in any event that portion thereof which activates a waking circuit for a detonation triggering sensor, is placed into operation; whereas in parallel with the return actuation of the securing arrangement 16 into the secured condition, the circuit 13 can be again switched off. Furthermore, provision can be made, that upon an incorrect input of the signal code 28 the triggering signal 15 will not be immediately emitted (for the triggering of a warhead or of a clearing block) but there is available to the combat engineer (determined from the standpoint of the circuitry) a number of input attempts. Only when this number has been exceeded is there initiated the triggering signal 15, inasmuch as, apparently, no authorized person has undertaken the attempt at re-securing. The number of permissible attempts must naturally be small in comparison with the number of the information variants for the clearing code 29, so that this cannot be disclosed by the input attempts.

What is claimed is:

1. Re-securable mine including a triggering circuit, comprising a trigger securing arrangement for actuating said trigger circuit; a mine re-securing block including a comparator for a predeterminable information and for introduceable information for resetting the securing arrangement into a secured position at a predetermined relationship between said two informations.

2. Mine as claimed in claim 1, wherein the informations are constituted of binary codes.

3. Mine as claimed in claim 1, wherein manually-actuatable switches are provided for entering the informations.

4. Mine as claimed in claim 1, wherein encoded cards are provided for the input of the informations.

5. Mine as claimed in claim 1, comprising an information data storage for the securing code.

6. Mine as claimed in claim 5, wherein the information data storage and an input storage comprise sequential components of a slide register.

7. Mine as claimed in claim 5, wherein the data storage is provided by a set of switch groups.

8. Mine as claimed in claim 1, wherein said comparator is responsive to only a predetermined existing relationship between said two informations.

9. Mine as claimed in claim 1, wherein said comparator alternatively provides for a triggering signal for a warhead by clearing a block or for transmitting a resetting signal to said securing arrangement.

10. Mine as claimed in claim 1, wherein said comparator implements the switching off of a detonating sensor-signal processing circuit.

11. Mine as claimed in claim 10, wherein said sensor-signal processing circuit is activatable through the setting of a predetermined information.

12. Mine as claimed in claim 1, wherein said securing arrangement is unsecurable through the setting of an information.

* * * * *